US007298254B2

(12) United States Patent
Tracy et al.

(10) Patent No.: US 7,298,254 B2
(45) Date of Patent: Nov. 20, 2007

(54) ALARM SYSTEM EMPLOYING SINGLE TRANSMISSION LINE

(75) Inventors: Larry Tracy, Auburn, CA (US); Akira Watanabe, Yokohama Kanagawa Prefecture (JP); Ichirou Horie, Yokohama Kanagawa Prefecture (JP)

(73) Assignee: Inet Consulting Limited Company (JP)

( * ) Notice: Subject to any disclaimer, the term of this patent is extended or adjusted under 35 U.S.C. 154(b) by 130 days.

(21) Appl. No.: 11/083,383

(22) Filed: Mar. 16, 2005

(65) Prior Publication Data

US 2006/0220832 A1 Oct. 5, 2006

(51) Int. Cl.
*G08B 1/00* (2006.01)

(52) U.S. Cl. ..... 340/531; 340/541; 348/152

(58) Field of Classification Search ..... 340/531, 340/541, 545.2, 565, 568.2, 937; 348/152, 348/159, 180

See application file for complete search history.

(56) References Cited

U.S. PATENT DOCUMENTS

| | | | | |
|---|---|---|---|---|
| 5,202,661 | A * | 4/1993 | Everett et al. | 340/522 |
| 6,081,193 | A * | 6/2000 | Trucchi et al. | 340/541 |
| 6,433,683 | B1 * | 8/2002 | Robinson | 340/540 |
| 7,068,166 | B2 * | 6/2006 | Shibata et al. | 340/541 |
| 2005/0267605 | A1 * | 12/2005 | Lee et al. | 700/19 |

* cited by examiner

*Primary Examiner*—Phung T. Nguyen
(74) *Attorney, Agent, or Firm*—DLA Piper US LLP

(57) ABSTRACT

In the present invention an intrusion detection system comprises a detection element configured to detect an intrusion in a location, and to transmit an intrusion signal upon detection of the intrusion. The system further comprises a monitoring device configured to capture images of the location upon the detection of the intrusion, and to transmit image signals representing the captured images. A single transmission line is in electrical communication with the detection element and the monitoring device, wherein the transmission line is configured to carry both the intrusion signals and the image signals.

21 Claims, 5 Drawing Sheets

ALARM SYSTEM EMPLOYING SINGLE TRANSMISSION LINE

BRIEF DESCRIPTION OF THE INVENTION

This invention relates generally to alarm systems. More specifically, this invention relates to alarm systems employing a single transmission line carrying signals from both sensing elements and monitoring devices.

BACKGROUND OF THE INVENTION

Conventional alarm systems, such as passive infrared (PIR) intrusion detectors, see extensive use for detecting and deterring intrusions such as break-ins or trespasses. One such alarm system is shown in block diagram form in FIG. 1. Here, an alarm system 10 has a sensing element 20 for detecting intrusions. The sensing element 20 is connected to an alarm indicator 30, typically by a pair of wires 40. The alarm system 10 also commonly has a camera 50 connected to a monitor 60, typically by a coaxial cable 70. In operation, the sensing element 20 and camera 50 are placed in proximity to the location at which intrusions are to be detected/prevented. The sensing element 20 detects intrusions upon this location, while the camera 50 captures images of the location to provide a visual record of any such intrusion. Upon detecting an intrusion, the sensing element 20 transmits a signal to the alarm indicator 30 across the wire 40, indicating that an intrusion has occurred. The alarm indicator 30 then initiates an alarm, such as an audible or visual signal that alerts people to the intrusion. The camera 50 provides positive confirmation if the sensing element did not trigger a false alarm. Thus, the image captured by the camera 50 is transmitted across the coaxial cable 70 and displayed on the monitor 60. In this conventional system, the alarm indicator 30 alerts people, spurring them to activate the camera 50 and/or watch the monitor 60 to determine more information about the intrusion. The use of the camera 50 reduces incidents of false alarm.

While often effective in detecting and monitoring intrusions, conventional alarm systems 10 suffer from certain drawbacks. Often, the sensing element 20 and camera 50 are located at or near the area to be monitored, while the alarm indicator 30 and monitor 60 are placed at a remote area. Accordingly, alarm systems such as alarm system 10 require two transmission lines, i.e. wires 40 and coaxial cable 70, to be extended between these areas. The use of two such cables instead of one consumes extra space and adds cost. Also, as these two areas can be far apart, additional effort and expense are required to install two lines instead of one. In addition, where a sensing element 20 with the associated alarm indicator 30 is already installed, retrofitting such a site would be expensive.

In the prior art, it is also known to use a plurality of cameras connected via a single co-axial cable to a plurality of monitors. Thus the cameras share their signals on the single co-axial cable. However, none of the cameras share their signals with the output of a sensing element which does not output a video frequency signal.

Accordingly, it is desirable to provide an alarm system that employs a single transmission line capable of carrying signals from both sensing element 20 and monitoring devices such as camera 70. The use of a single transmission line eliminates the need for a second line, reducing overall system cost and effort in installation, and permits greater number of existing alarm sensors 20 to be retrofitted with cameras 70 to reduce false alarms.

SUMMARY OF THE INVENTION

The invention can be implemented in numerous ways, including as a method, system, and device. Various embodiments of the invention are discussed below.

In the present invention an intrusion detection system comprises a detection element configured to detect an intrusion in a location, and to transmit an intrusion signal upon detection of the intrusion. The system further comprises a monitoring device configured to capture images of the location upon the detection of the intrusion, and to transmit image signals representing the captured images. Finally the system comprises a transmission line in electrical communication with the detection element and the monitoring device, the transmission line configured to carry the intrusion signals and the image signals.

Other aspects and advantages of the invention will become apparent from the following detailed description taken in conjunction with the accompanying drawings which illustrate, by way of example, the principles of the invention

BRIEF DESCRIPTION OF THE DRAWINGS

For a better understanding of the invention, reference should be made to the following detailed description taken in conjunction with the accompanying drawings, in which.

Like reference numerals refer to corresponding parts throughout the drawings.

DETAILED DESCRIPTION OF THE INVENTION

In one sense, the invention relates to an improved alarm system that utilizes a single transmission line instead of the dual transmission lines often required in conventional alarm systems. Alarm systems often have sensing elements that detect intrusions, and monitoring devices such as cameras for confirming the alarm detection by capturing a visual record of the intrusion. Instead of employing separate transmission lines for each element or device, a combiner circuit transmits signals from the sensing elements and the monitoring devices on the same transmission line. At the other end of this transmission line, a separator circuit receives these signals and, upon detecting a signal from the sensing elements, transmits an alarm signal to the components of the alarm system that initiate an alarm. The separator circuit also routes the camera signals to those components of the alarm system that record/display images from the camera.

By combining signals from the sensing elements and camera, then separating the signals downstream and sending them to their appropriate destinations, the combiner and separator circuits allow for a conventional single transmission line, such as a single cable comprising of four wires (two to carry signal, and two to carry power), to be used. In contrast to the dual transmission lines required by many conventional systems, the use of a single transmission line allows for more inexpensive alarm systems that are also easier and quicker to install. Finally, the cost of retrofitting an existing alarm sensor with an additional camera is greatly reduced.

Figure 1:
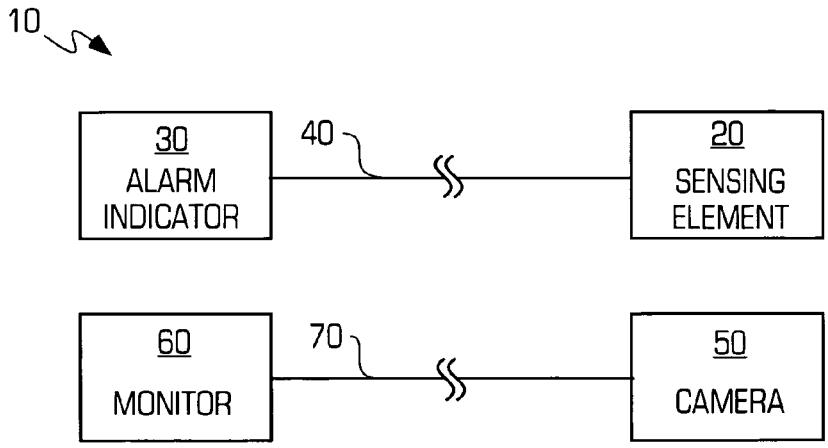
FIG. 1 (PRIOR ART)
FIG. 1 illustrates a block diagram of a conventional alarm system employing two transmission lines.
Figure 2:
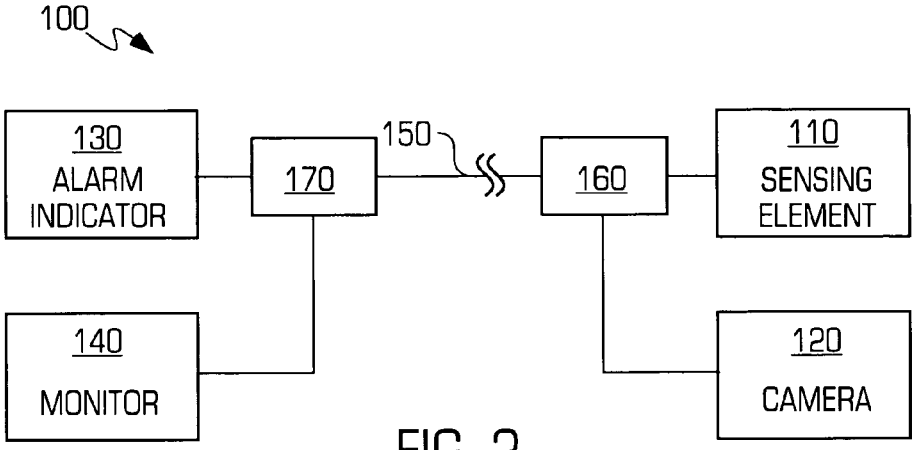
FIG. 2 illustrates a block diagram of an alarm system constructed in accordance with embodiments of the invention, and employing a single transmission line.

FIG. 2 illustrates a block diagram of a single-transmission-line alarm system constructed in accordance with embodiments of the invention. The alarm system 100 employs a sensing element 110 to detect intrusion, and a camera 120 to monitor and/or record details of the intrusion. As above, the sensing element 110 and camera 120 are often placed in proximity to the location that is to be monitored for intrusion, while an alarm indicator 130 and monitor 140 are placed in a different location. A single transmission line 150 extends between the sensing element 110 and camera 120 at one location, and the alarm indicator 130 and monitor 140 at another location. This single transmission line 150 carries signals from both the sensing element 110 and camera 120. That is, the sensing element 110 transmits an intrusion detection signal when it detects an intrusion in the area it is monitoring. Similarly, the camera 120 transmits video signals, or other electronic image signals, that provides details of the intrusion. Unlike the conventional alarm system 10 of FIG. 1, this transmission line 150 is set up to carry both the intrusion signals from sensing elements 110, and the video or other image signals from the camera 120.

In order to carry signals from both a sensing element 110 and camera 120 on the same line, transmission line 150 includes a combiner circuit 160 for combining signals from both these elements onto the same line, as well a separator circuit 170 for directing different components of the combined signal to different destinations. In operation then, the combiner circuit 160 combines signals from the sensing element 110 and camera 120 onto the same transmission line 150. These combined signals travel downstream along the transmission line 150 to the separator circuit 170, which directs the video or image signals to the monitor 140, and transmits alarm signals to the alarm indicator 130. In this manner, different signals from different sources of an alarm system (i.e., sensing element 110 and camera 120) are combined onto a single transmission line 150, where they are later separated and routed to different destinations (i.e., the alarm indicator 130 and monitor 140). Such a configuration allows this single transmission line to take the place of the dual transmission lines 40, 70 of FIG. 1, yielding an alarm system that is cheaper and more easily installed than conventional alarm systems.

Figure 3:
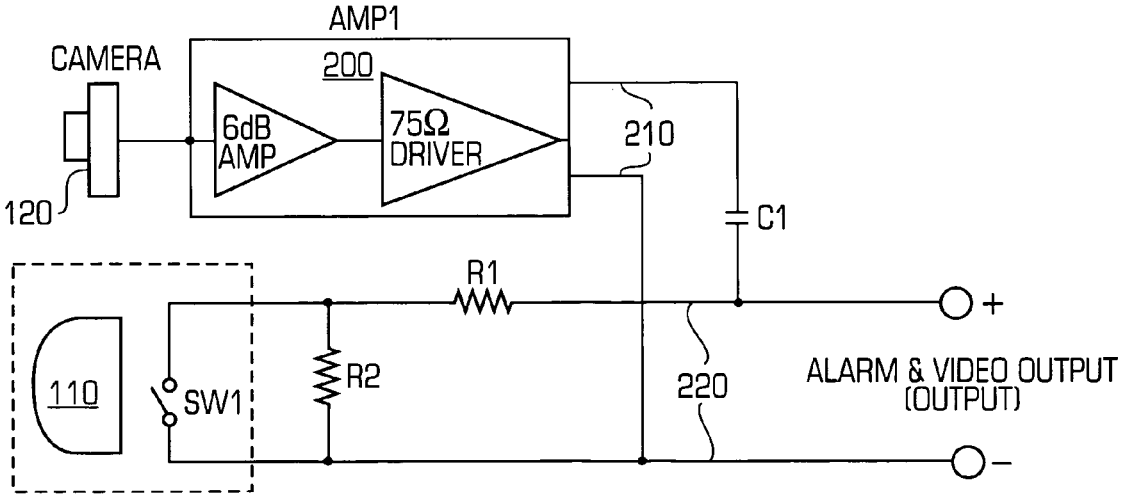
FIG. 3 illustrates a schematic of a combiner circuit for combining signals onto a single transmission line in accordance with embodiments of the invention.

FIG. 3 illustrates details of the combiner circuit 160. In this circuit, the camera 120 generates video or image signals that are amplified by the amplifier 200 and transmitted along the wire pair 210, where they are combined with signals from the sensing element 110 along the wire pair 220. The components are known components commonly employed in current alarm systems. For example, the amplifier 200 is a known component that typically employs a 6 dB amplifier coupled with a 75Ω driver to amplify image signals from the camera 120.

In addition, one of skill will realize that the invention does not limit itself to the use of these specific components, but rather employs them as an example of the more general concept of combining separate signals from any sensing elements and any monitoring devices onto any single transmission line. Accordingly, the sensing element 110 and camera 120 can be any devices used in alarm systems to detect and monitor intrusions. For instance, the sensing element 110 can be a passive infrared (PIR) detector capable of detecting infrared radiation given off by potential intruders. However, the sensing element 110 can also be a microwave detector, a photo beam detector, a glass break sensor, a door contact sensor, or any other sensing element capable of being employed to detect an intrusion. Likewise, the camera 120 is commonly a video camera for capturing video images of intruders, but it can also be any device for monitoring the location of a potential intrusion, such as a still-frame camera or any other audio/video recording device. In addition, the combiner circuit of FIG. 3 combines signals from both the sensing element 110 and camera 120 onto a single line 220. This line is typically a four wire cable (in which two lines carry power, and two lines carry signal), but can be any wire or other electrical transmission line capable of carrying signals from both a sensing element and a monitoring element of an alarm system.

Figure 4:
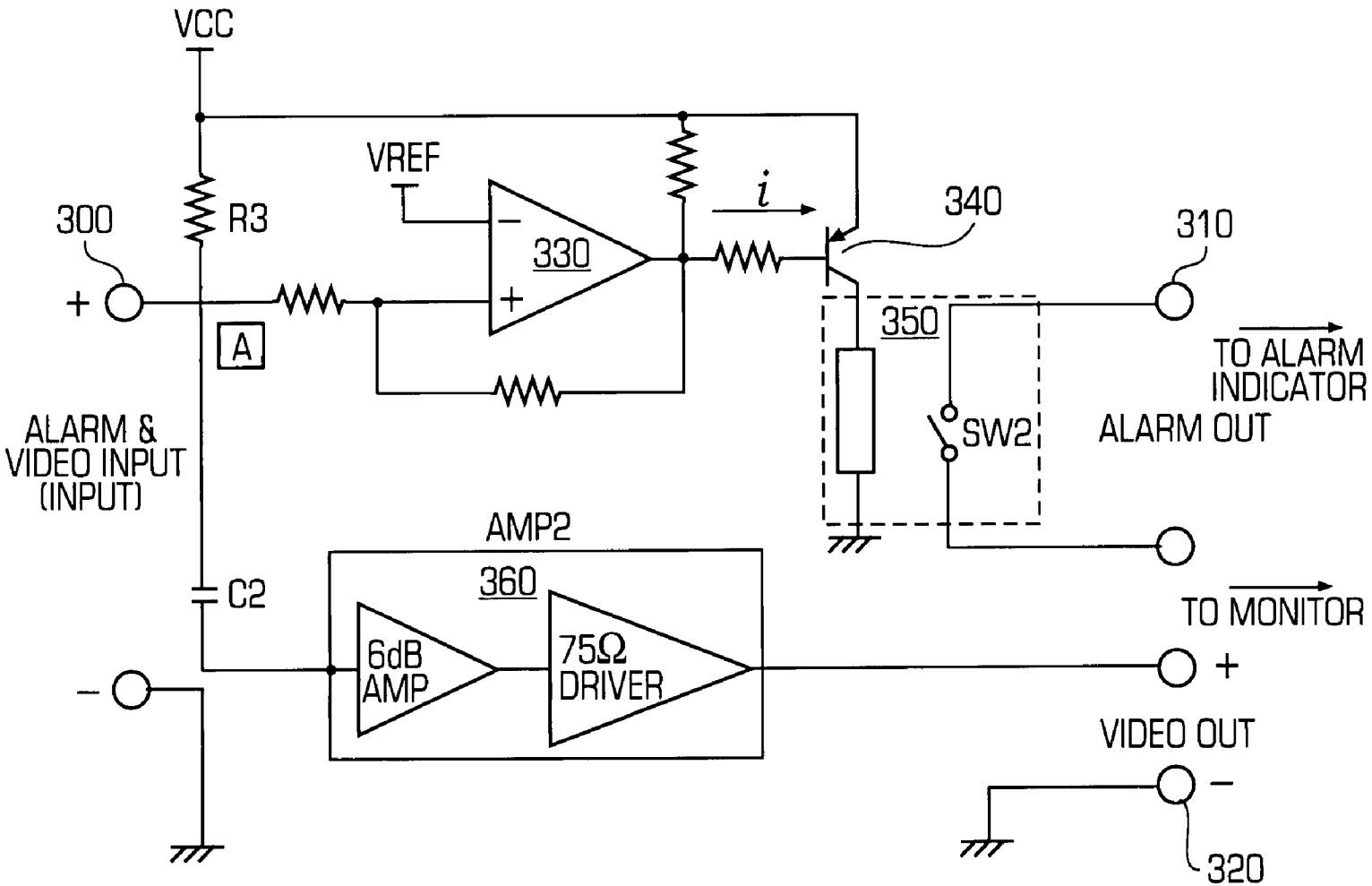
FIG. 4 illustrates a schematic of a separator circuit for directing signals from the single transmission line to different components of the alarm system.

The combined signals are transmitted along the transmission line 220 (i.e., the transmission line 150 of FIG. 2) where they are detected and processed by the separator circuit 170. FIG. 4 illustrates further details of the separator circuit 170. Signals transmitted along the transmission line 220 are received at terminal 300, where they are routed to an alarm indicator terminal 310 and a video terminal 320. More specifically, intrusion detection signals sent from the sensing element 110 are amplified and routed to the alarm indicator terminal 310, then on to the alarm indicator 130. Conversely, video signals from the camera 120 are routed to the video terminal 320 and on to the monitor 140. In embodiments employing intrusion detection signals that are of greater magnitude than image signals, one of skill will observe that the reference voltage $V_{ref}$ input to the operational amplifier 330 can be set sufficiently high that only the presence of the intrusion detection signal, and not the image signals by themselves, will trigger the operational amplifier 330 to output a positive voltage. This voltage, in turn, induces an emitter-base current i sufficient to trigger the transistor 340 to pass a current that toggles the switch 350, triggering the alarm indicator 130 to signal an alarm alerting the presence of an intrusion.

While the intrusion detection signal acts to generate a signal that toggles the switch 350, the image signals are amplified by amplifier 360 (similar to the amplifier 200 of FIG. 3) and output to the video terminal 320. As these video or image signals can be superposed with intrusion detection signals, embodiments of the invention may also require known filters for attenuating the intrusion detection signals. Alternatively, the monitor 140 or other such monitoring device may be designed to filter or otherwise effectively ignore intrusion detection signals in known fashion.

Figure 5A:
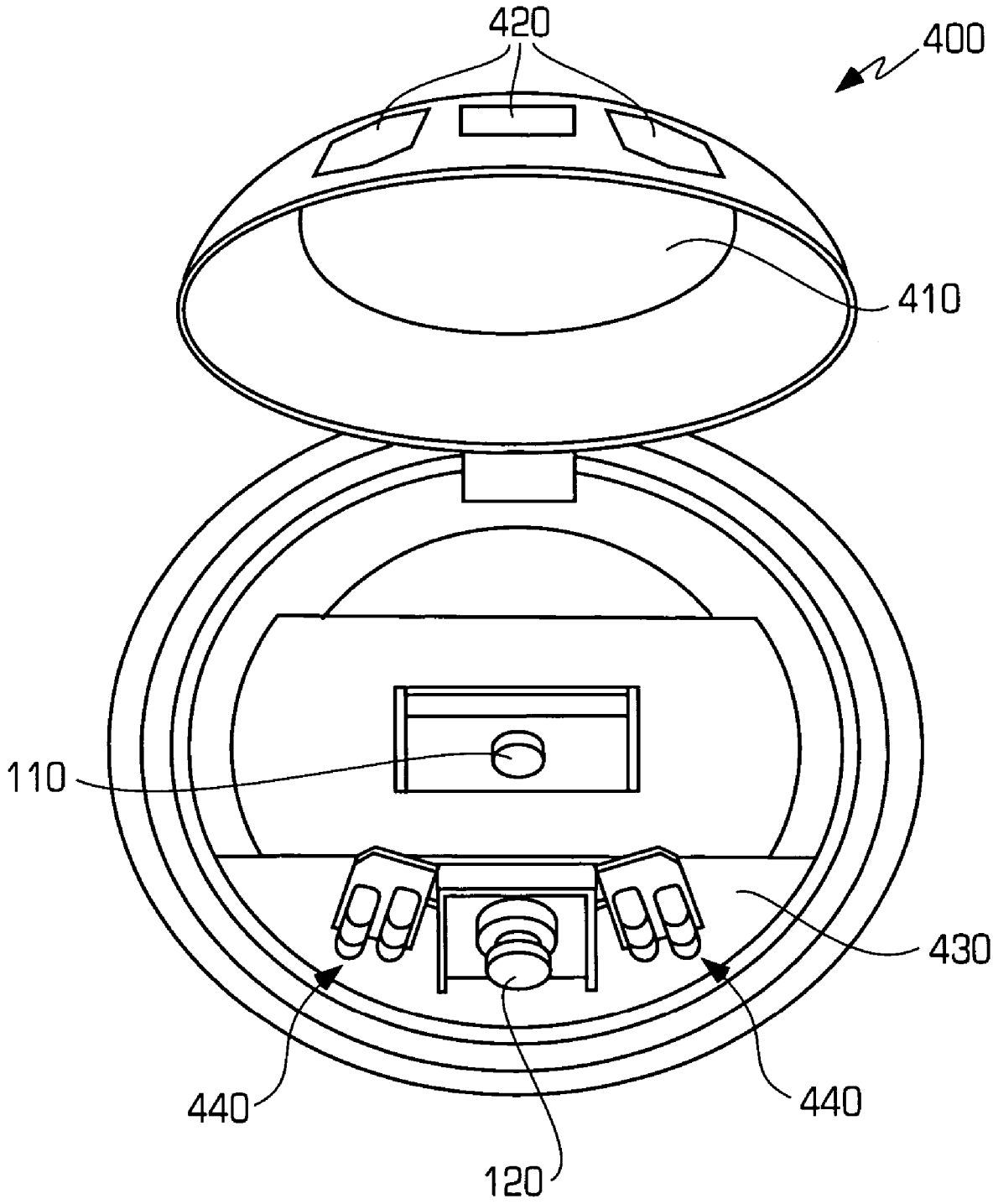
FIGS. 5A-5C illustrate diagrammatic open top, closed side, and closed top views, respectively, of a housing containing a sensing element and camera, for use in embodiments of the invention.
Figure 5B:
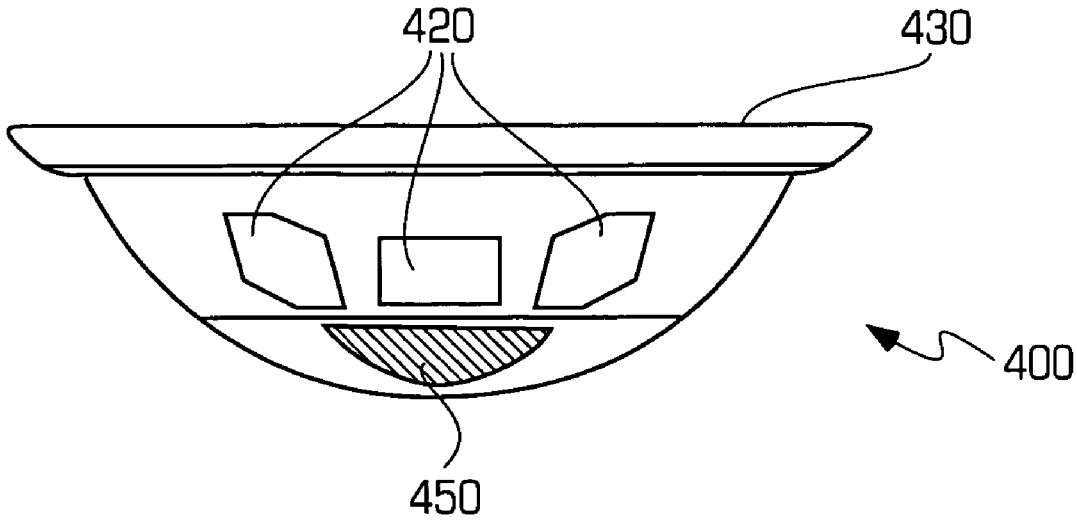
Figure 5C:
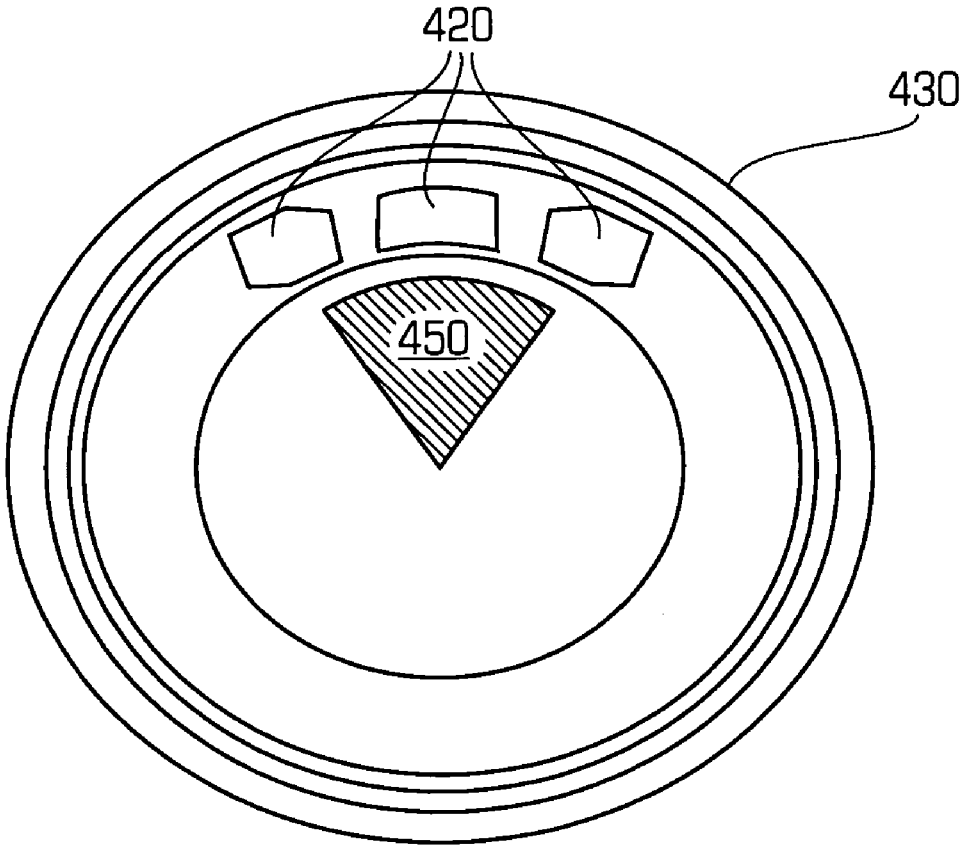

As previously mentioned, the sensing element 110 and camera 120 are often co-located. As a result, some embodiments of the invention integrate both these components within a single housing. This single housing produces alarm systems that are particularly easy to install and use, as such alarm systems include both a single transmission line and a single housing. FIGS. 5A-5C illustrate various views of one such housing configuration. Here, a housing 400 includes a cover 410 that is a rigid protective cover with windows 420. The housing 400 also has a base portion 430 that can be attached to a surface, and that is configured to support the sensing element 110 and camera 120 within. It may be desirable to provide light emitting diode (LED) lights 440 for illuminating the area monitored by the camera 120. As noted above, the sensing element 110 can be any sensor capable of detecting an intrusion. Here, it is shown as a pyroelectric sensing element for sensing infrared radiation emitted by an intruder. Also, the camera 120 can be any imaging device, but here is shown as a complementary metal oxide semiconductor (CMOS) solid-state camera. The operation of the pyroelectric sensing element and CMOS camera are known.

As shown in FIGS. 5A-5C, the cover 410 can be opened (FIG. 5A) to allow access to the sensing element 110, camera 120, and lights 440 for repair or maintenance, and can be closed (FIGS. 5B-5C) to protect these components during operation. When the cover 410 is closed, the windows 420 allow light in for the camera 120, and allow light from the lights 440 out, so as to illuminate the location to be monitored. The illumination is turned on by the sensing element 110 upon sensing an intrusion, but only if a photocell (not shown) indicates that the ambient light is insufficient for the camera 20 to capture the image of the area. A lens 450 can also be incorporated into the cover 410 to allow a field of view for the sensing element 110. This lens 450 can be a simple opening, or an optic lens, such as a fresnel lens, that focuses light upon the sensing element 110 in specified ways. Thus, the housing 400 containing lights 440, camera 120 and sensing element 110 reflects a unique packaging of elements.

Figure 6A:
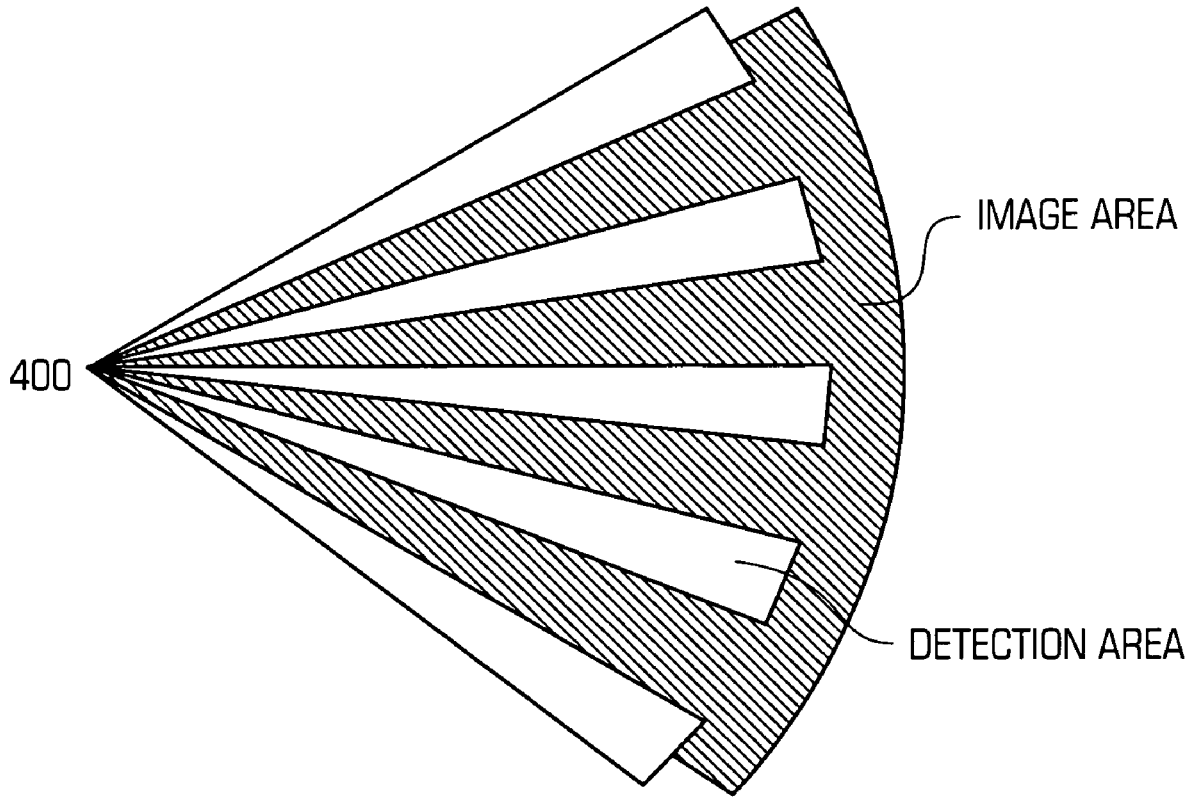
FIGS. 6A-6B illustrate top and side views, respectively, of the fields of view of the sensing element and camera from within the housing of FIGS. 5A-5C.
Figure 6B:
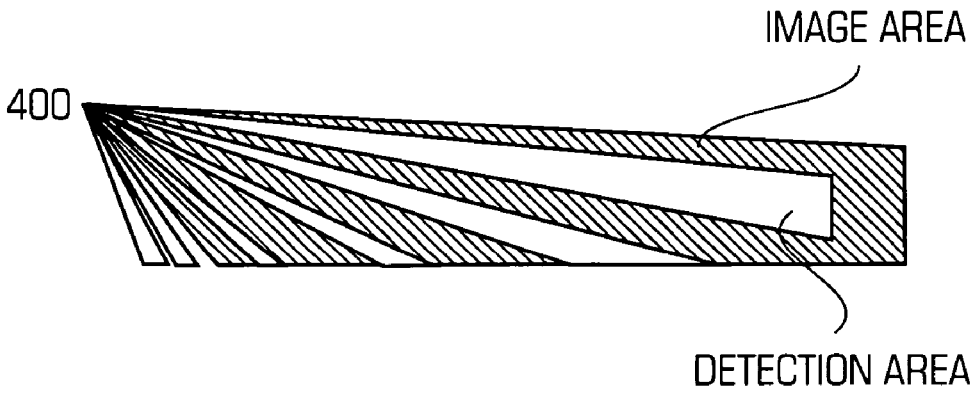

In embodiments employing a lens such as a fresnel lens, light paths to/from the sensing element 110 are modified so as to provide a field of view that facilitates the ability of the sensing element 110 to detect intrusion. More specifically, the lens 450 allows the sensing element 110 to better detect intrusion across a field of view. FIGS. 6A-6B illustrate top and side views, respectively, of the field of view of the camera 120 and sensing element 110 from within the housing 400. As shown, the windows 420 allow the camera 120 to detect and capture images of any object within its image area. Also, the fresnel lens 450 focuses light from the detection areas shown, so as to facilitate detection of an intrusion when the intruder traverses from one detection area to an adjacent detection area. Thus, in known fashion, the sensing element 110 detects motion, and thus an intrusion, when an object moves from one detection area to another.

One of skill will observe that the invention is not limited to embodiments employing housings, but rather merely discloses sensing elements and monitoring devices. Similarly, housings of the invention are not limited to single-housing configuration, nor to the configuration shown in FIGS. 5A-5C. Rather, the invention can include any housing having any configuration for supporting and/or protecting one or more components of an alarm system.

The foregoing description, for purposes of explanation, used specific nomenclature to provide a thorough understanding of the invention. However, it will be apparent to one skilled in the art that the specific details are not required in order to practice the invention. Thus, the foregoing descriptions of specific embodiments of the present invention are presented for purposes of illustration and description. They are not intended to be exhaustive or to limit the invention to the precise forms disclosed. Many modifications and variations are possible in view of the above teachings. For example, alarm systems constructed according to the invention can employ any type and number of sensing element and any type of monitoring device. Similarly, the signals from these sensing elements and devices can be combined for transmission on any type of transmission line. The embodiments were chosen and described in order to best explain the principles of the invention and its practical applications, to thereby enable others skilled in the art to best utilize the invention and various embodiments with various modifications as are suited to the particular use contemplated.

What is claimed is:

1. An intrusion detection system comprising:

a detection element configured to detect an intrusion into a location, and to transmit an intrusion signal upon detection of the intrusion;

a monitoring device configured to capture images of the location upon the detection of the intrusion, and to transmit image signals representing the captured images; and a transmission line in electrical communication with the detection element and the monitoring device, the transmission line configured to carry the intrusion signals and the image signals;

wherein the transmission line is a four wire transmission line.

2. The intrusion detection system of claim 1 wherein the detection element is a PIR detector.

3. The intrusion detection system of claim 1 wherein the detection element is a microwave detector.

4. The intrusion detection system of claim 1 wherein the detection element is a photo beam detector.

5. The intrusion detection system of claim 1 wherein the detection element is a glass break sensor.

6. The intrusion detection system of claim 1 wherein the detection element is a door contact sensor.

7. The intrusion detection system of claim 1 wherein the monitoring device is a video camera.

8. An intrusion detection system comprising:

a detection element configured to detect an intrusion into a location, and to transmit an intrusion signal upon detection of the intrusion;

a monitoring device configured to capture images of the location upon the detection of the intrusion, and to transmit image signals representing the captured images;

a transmission line in electrical communication with the detection element and the monitoring device, the transmission line configured to carry the intrusion signals and the image signals;

a combiner circuit in electrical communication with the transmission line and configured to combine the intrusion signal and the image signals so as to emit a combined signal to the transmission line; and a separator circuit in electrical communication with the transmission line and the combiner circuit;

wherein the separator circuit is configured to receive the combined signal, and to transmit an alarm signal to a first signal receiving device, the alarm signal corresponding to the intrusion signal of the combined signal; and wherein the separator circuit is further configured to transmit the image signals of the combined signal to a second signal receiving device.

9. The intrusion detection system of claim 8 wherein the first signal receiving device is an alarm indicator configured to emit an indication of an alarm upon receiving the alarm signal.

10. The intrusion detection system of claim 8 wherein the second signal receiving device is a monitor configured to display the captured images upon receiving the image signals.

11. A transmission system for use in an intrusion detection system, comprising;

an electrical transmission line configured to be placed in simultaneous electrical communication with an intrusion detection element for detecting an intrusion, and an intrusion monitoring device for viewing details of the intrusion, wherein the electrical transmission line is further configured to be placed in simultaneous electrical communication with an alarm indicating device for initiating an alarm in response to receiving an alarm signal, and a display device for displaying images corresponding to the image signals;

a combiner circuit in electrical communication with the electrical transmission line, the combiner circuit configured to combine an intrusion signal received from the detection element with image signals received from the monitoring device, so as to transmit a combined signal along the electrical transmission line; and a separator circuit in electrical communication with the electrical transmission line, the separator circuit configured to receive the combined signal, to generate the alarm signal in response to the combined signal, to transmit the alarm signal along the electrical transmission line to the alarm indicating device, and to transmit the image signals of the combined signal along the electrical transmission line to the monitoring device.

12. A transmission system for use in an intrusion detection system, comprising;

an electrical transmission line configured to be placed in simultaneous electrical communication with an intrusion detection element for detecting an intrusion, and an intrusion monitoring device for viewing details of the intrusion; and a combiner circuit in electrical communication with the electrical transmission line, the combiner circuit configured to combine an intrusion signal received from the detection element with image signals received from the monitoring device, so as to transmit a combined signal along the electrical transmission line;

wherein the electrical transmission line is a four wire cable.

13. The transmission system of claim 12 wherein the electrical transmission line is further configured to be placed in simultaneous electrical communication with an alarm indicating device for initiating an alarm in response to receiving an alarm signal, and a display device for displaying images corresponding to the image signals.

14. The transmission system of claim 12 wherein the display device is a video camera.

15. The transmission system of claim 12 wherein the intrusion detection element is a PIR sensor.

16. A method of detecting an intrusion, comprising:

generating an intrusion detection signal upon detecting an intrusion; transmitting the intrusion detection signal alone an electrical transmission line;

generating image signals corresponding to images of details of the intrusion; and transmitting the image signals along the electrical transmission line;

wherein the transmitting the intrusion detection signal further comprises transmitting the intrusion detection signal along a four wire cable, and wherein the transmitting the image signals further comprises transmitting the image signals along the four wire cable.

17. The method of claim 16 further comprising:

receiving the intrusion detection signal and the image signals from the electrical transmission line;

generating an alarm signal in response to the receiving of the intrusion detection signal, the alarm signal configured to initiate an alarm;

transmitting the alarm signal to an alarm indicator; and transmitting the image signals to a display device.

18. The method of claim 16 further comprising:

receiving the intrusion detection signal and the image signals from the electrical transmission line;

generating an alarm signal in response to the receiving of the intrusion detection signal, the alarm signal configured to initiate an alarm.

19. A unitary intrusion detection device comprising:

a housing;

a detection element, in said housing, configured to detect an intrusion into a location, and to transmit an intrusion signal upon detection of the intrusion;

a monitoring device, in said housing, configured to capture images of the location upon the detection of the intrusion, and to transmit image signals representing the captured images;

an illumination element, in said housing, configured to illuminate the location; and a combiner circuit including a first input for receiving the intrusion signal, a second input for receiving the image signals, an output arranged to be electrically connected to an electrical transmission line, and processing circuitry configured to create a combined signal and transmit the combined signal to the output, the processing circuitry creating a combined signal representative of both the intrusion signal and the image signal, and configuring the combined signal for transmission over a single four wire cable transmission line.

20. The device of claim 19 wherein the detection element is a PIR sensor.

21. The device of claim 19 wherein the detection element is a photo beam detector.

* * * * *